US006170651B1

(12) United States Patent
Taormina

(10) Patent No.: US 6,170,651 B1
(45) Date of Patent: Jan. 9, 2001

(54) MULTI-PURPOSE EYEGLASS HOLDING AND CLEANING KIT

(76) Inventor: David M. Taormina, 20665 Seneca Dr., Clinton Twp., MI (US) 48036

( * ) Notice: Under 35 U.S.C. 154(b), the term of this patent shall be extended for 0 days.

(21) Appl. No.: 09/466,115

(22) Filed: Dec. 17, 1999

(51) Int. Cl.[7] ..... A45C 11/04

(52) U.S. Cl. ..... 206/5; 206/6; 206/229; 206/233

(58) Field of Search ..... 206/5, 6, 223, 206/229, 494; 221/45, 96

(56) References Cited

U.S. PATENT DOCUMENTS

| | | | | |
|---|---|---|---|---|
| D. 406,696 | | 3/1999 | Conway . | |
| 3,113,579 | | 12/1963 | Willis . | |
| 3,623,492 | | 11/1971 | Frantz et al. . | |
| 4,951,811 | | 8/1990 | Lines . | |
| 4,960,208 | * | 10/1990 | Tempke | 206/6 |
| 5,344,002 | | 9/1994 | Baczkowski . | |
| 5,439,104 | * | 8/1995 | Wolska-Klis | 206/233 |
| 5,526,924 | * | 6/1996 | Klutznick | 206/5 |
| 5,803,244 | | 9/1998 | Shefler et al. . | |
| 5,921,383 | * | 7/1999 | Shefler et al. | 206/5 |

* cited by examiner

*Primary Examiner*—David T. Fidei
(74) *Attorney, Agent, or Firm*—Gifford, Krass, Groh, Sprinkle, Anderson & Citkowski, P.C.

(57) ABSTRACT

A multi-purpose eyeglass holding and cleaning kit capable of storing a pair of eyeglasses and including a body with an outer shell constructed of a durable material, the body having a selected length, width and thickness which defines a generally elongate article with a first end and a second end and defining, in combination, a hollow interior suitable for receiving in inserting fashion the pair of the eyeglasses eyeglasses. A hingedly secured portion is secured to the body at a desired location and is actuated from a closed position to an open position in order to reveal an interior of the shell interior and to permit the insertion or removal of the pair of eyeglasses. A volume of a glass lens cleaning solution is contained within the shell at a first selected location, the cleaning solution further including a dispensing pump incorporated within the body. A plurality of tissues is contained within the shell and is accessible from a second selected location. When the pair of eyeglasses are removed from the body, the dispensing pump is employed in a first step to apply cleaning solution to the surfaces of the eyeglass lenses and a selected one or more tissues are withdrawn from the shell in a second step to wipe dry the solution from the cleaned lenses.

11 Claims, 4 Drawing Sheets

MULTI-PURPOSE EYEGLASS HOLDING AND CLEANING KIT

BACKGROUND OF THE INVENTION

1. Field of the Invention

The present invention relates generally to eyeglass carrying and storage cases, as well as to eyeglass cleaning devices and, more particularly, to a combination and multi-purpose eyeglass holding and cleaning kit.

2. Description of the Prior Art

Eyeglass holding cases and eyeglass cleaning devices are by themselves very well known in the art. Numerous types and constructions of eyeglass holding sleeves constructed of soft vinyl and leather are known, as are hardened shell cases typically constructed of polymerized materials.

Some attempts have been made in the prior art to combine the features of eyeglass holding and eyeglass cleaning/polishing devices. A notable example of this is set forth in U.S. Pat. No. 5,344,002, issued to Baczkowski, and which discloses a combination eyeglass lens polisher and holder device. The device of Baczkowski includes the provision of an elongated, flexible and resilient bottom strip having opposite ends, a bottom surface and an opposite upper surface. The bottom surface is constructed of a flexible and non-abrasive surface and is adapted for polishing the glasses lens. A pair of flexible, resilient eyeglass holder pockets are secured to the upper surface of the bottom strip adjacent its opposite ends and are spaced apart to define a central foldable portion therebetween. The pockets hold a pair of eyeglasses, with each lens contained within an associated pocket. The eyeglasses are polished upon being removed from the pockets, by inserting the thumb into one pocket, the forefinger and middle finger of the same hand into the other pocket, folding the device around the central foldable portion, and embracing the selected eyeglass lens between to polish it by applying kneading action of the non-abrasive surfaces against each of the lenses in succession.

Although providing an interesting example of carrying a pair of eyeglasses in a soft, flexible covering member, the device of Baczkowski does not provide any level of durable and crush-resistant protection to the eyeglasses held within and further does not provide any form of a fluid wetting/cleaning solution. The non-abrasive opposing surfaces defined upon the Baczkowski pockets are further inapplicable in combination with a suitable spray or wetting solution which has been found to be most effective for cleaning eyeglass lenses.

A further example of a combined eye glass and contact lens and accessories case is illustrated in U.S. Pat. No. 4,951,811, issued to Lines. The Lines patent discloses combining the glasses with a contact lens case, a first wetting solution bottle, and a second cleaning solution bottle. As illustrated, the carrying case may be folded upon itself through the use of Velcro strips. A small rectangular mirror is glued to the fabric material along one inwardly facing surface as illustrated.

As with Baczkowski, the Lines patent is likewise directed to a flexible carrying case. Further, wetting and cleaning solution bottles are disclosed as being directed for use with the contact lenses and no provision is made for employing either or both without first removing them from within associated pockets formed in the fabric material.

SUMMARY OF THE PRESENT INVENTION

The present invention is a novel and useful multi-purpose eyeglass holding and cleaning kit which is capable of storing a pair of eyeglasses in a convenient and secure fashion, as well as providing the ability to quickly remove and clean the eyeglasses using both a fluid cleaning solution and one or more non-abrasive lens tissue wipes.

According to a first preferred embodiment, the body is constructed with an outer shell of a durable material. The body is shaped so as to form an generally rounded and elongate article and three dimensional article with first and second ends, the first end including a hingedly secured portion capable of being actuated from an closed position to an open position and defining a hollow interior suitable for receiving in inserting fashion a pair of eyeglasses. The hingedly secured portion includes an interior cavity within which is contained a plurality of tissues, a covering layer enclosing the tissues and further having defined therethrough an aperture for permitting successive withdrawing of the tissues.

A volume of a glass cleaning solution is contained within the shell of the body and, in one particular variant of the first preferred embodiment, includes a dispensing pump mechanism with a depressible spray head which is revealed upon actuation of a further hingedly secured portion attached to the second end. Accordingly, the further hingedly secured portion actuates at an end of the body which is both opposite the initial hingedly secured portion responsible for revealing the hollow interior for holding the eyeglasses and offset in a lateral direction so that the body defines an axially extending subcompartment for accommodating the eyeglass cleaning solution which is separated from the eyeglass holding interior.

According to further variants, the eyeglass cleaning solution may further include an insertable and affixable transparent tube within which the volume of cleaning solution is held, the tube being slidingly engaged within the designated subcompartment at the opposite end of the body. An externally viewable and transparent fluid measuring window is provided along a selected edge of the body and in proximity to the insertable tube so that a visual inspection can be made as to when it is necessary to refill the cleaning solution.

Another variation of the first preferred embodiment contemplates dispensing with the insertable and transparent tube in favor of an integrally formed and fluid-tight sealing subcompartment and into which directly is poured the desired volume of cleaning solution. In either variant, an elongate fluid withdrawal stem which terminates in the spray pump head is employed to effectively withdraw the cleaning solution. The integrally formed and fluid-tight sealing compartment may be defined in elongate and axial extending fashion along a selected one of first and second extending and generally flattened faces between the first and second ends. Alternatively, the integrally formed compartment may be defined in likewise elongate and axial extending fashion along a selected one of first and second sides between the first and second ends. Either variant described herein defines a sufficient subcompartment separate from the hollow interior for holding the eyeglasses.

According to a further preferred embodiment, the body includes an outer shell constructed of a durable material, said body having a selected length, width and thickness with first and second flattened faces, a first extending side, a second extending side, a first end and a second end which defines in combination a generally elongate and rectangular shaped article with a hollow interior suitable for receiving in inserting fashion the pair of eyeglasses. A tissue withdrawing aperture is formed along a selected one of the flattened faces and in proximity to a tissue holding subcompartment defined within the body. An elongate, planar shaped and hingedly secured portion extends across the selected flattened face. The portion is hingedly connected along an edge location of the body separating the selected flattened face and an adjoining extending side and is actuable from a first closed position to a second open position to reveal the tissue withdrawing aperture.

A selected one of the first and second ends is further defined by a further hingedly secured portion which is actuated from a closed position to an open position in order to reveal an interior of the body shell and to permit the insertion or removal of the pair of eyeglasses. A volume of a glass lens cleaning solution is contained within the shell, the cleaning solution further including a dispensing pump incorporated within the body. The dispensing pump including a depressible head which is revealed upon actuating the further hingedly secured portion to the open position. Upon removing the pair of eyeglasses are removed from the body, the dispensing pump is again employed in a first step to apply a volume of the cleaning solution to the surfaces of the eyeglass lenses and a selected one or more tissues are withdrawn from the tissue holding subcompartment in a second step to wipe dry the solution from the cleaned lenses.

BRIEF DESCRIPTION OF THE DRAWINGS

Reference will now be made to the attached drawings, when read in combination with the following specification, wherein like reference numerals refer to like parts throughout the several views, and in which.

DETAILED DESCRIPTION OF THE PREFERRED EMBODIMENTS

Figure 1:
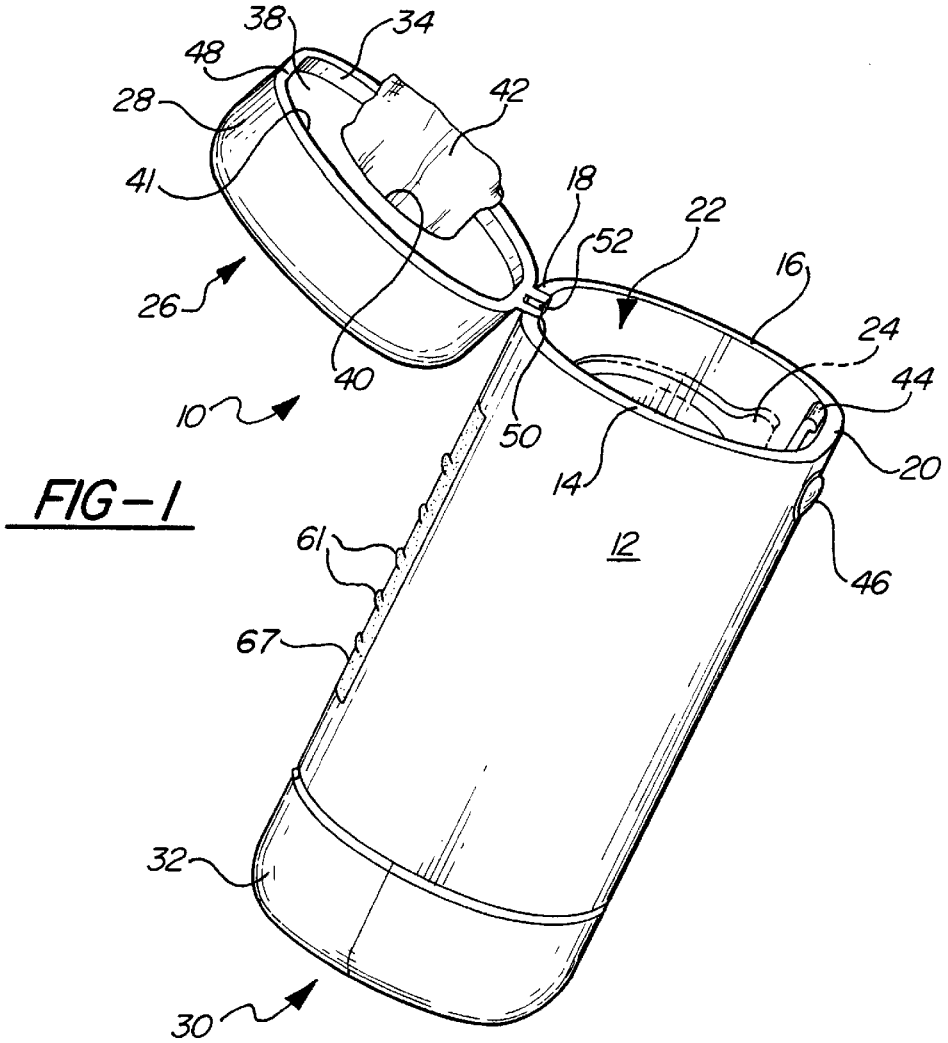
FIG. 1 is a perspective view of the multi-purpose eyeglass holding and cleaning kit according to the first preferred embodiment of the present invention.

Referring now to FIG. 1, a perspective view is shown at 10 of a multipurpose eyeglass holding and cleaning kit according to the first preferred embodiment of the present invention. A body 12 of the kit is constructed with an outer shell of a durable material, and particularly a plasticized or vinyl material or a combination of both. The body 12 according to the first preferred embodiment further has a selected length, width and thickness defined by a first generally flattened face 14 and a second generally flattened face 16. A first elongate, axial extending and generally arcuate extending side 18 and a second opposite and likewise extending side 20 combine with the first and second generally flattened faces 14 and 16 to define a generally elongate article with a hollow interior 22 suitable for receiving in inserting fashion the pair of eyeglasses 24, the body 12 further having a first closed end 26 defined by a hingedly secured portion 28 and a second closed end 30 which is also defined in part by a further hingedly secured portion 32.

Figure 2:
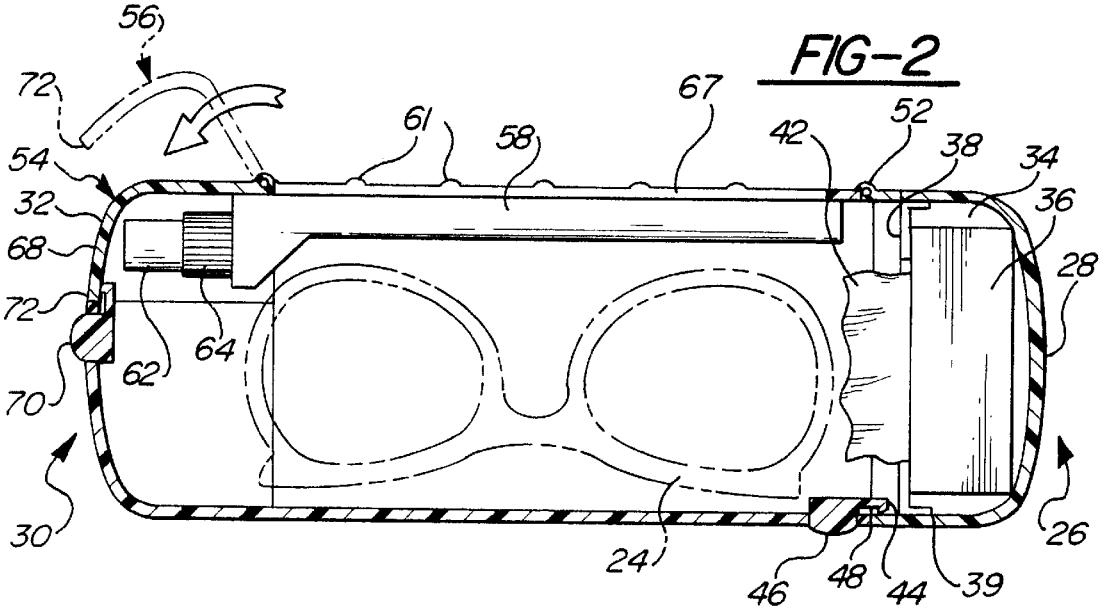
FIG. 2 is a frontal view in cutaway of the multi-purpose eyeglass kit as shown in FIG. 1 and further illustrating a variant of the arrangement of the plurality of tissues and the glasses spray cleaning solution.
Figure 2A:
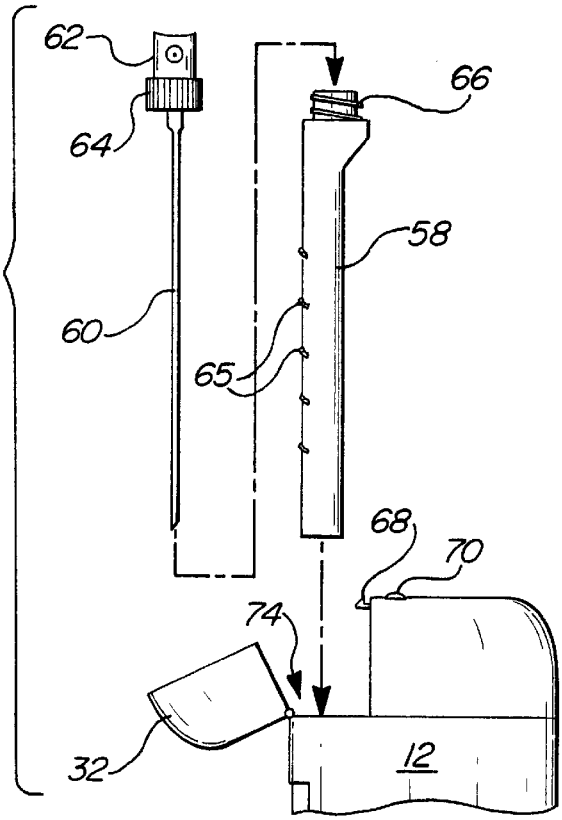
FIG. 2*a* is an exploded view in partial section of the variant illustrated in FIG. 2 and in which the eyeglass kit includes the insertable and affixable transparent tube which is received within an opening in the second end of the body and defining a subcompartment within the body interior.
Figure 2B:
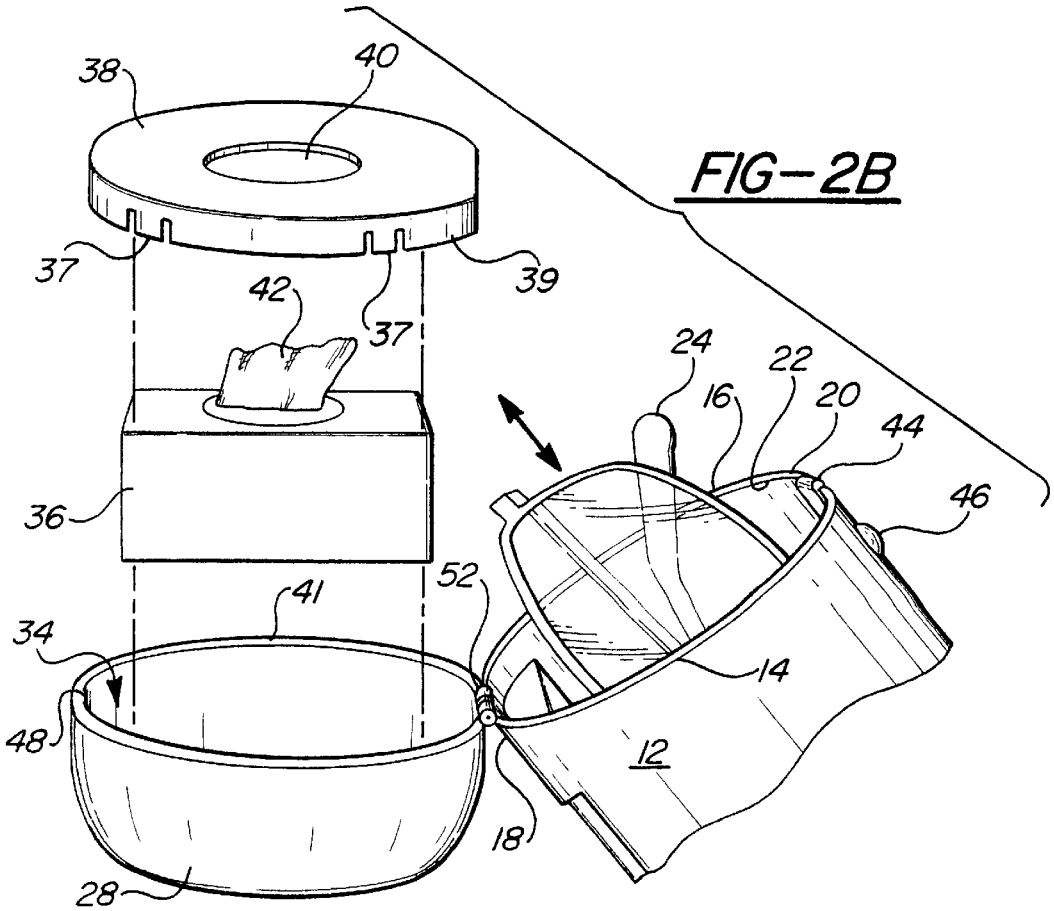
FIG. 2*b* is a further exploded view in partial section of the variant illustrated in FIG. 2 and showing the manner in which the plurality of tissues are held in place within a cavity defined in the interior of the first hingedly secured portion and including a covering layer with an aperture formed therethrough for permitting selective withdrawing of the tissues.

Referring again to FIG. 1, and also to FIGS. 2 and 2*b*, the initial hingedly secured portion includes an interior cavity 34 and within which is contained a plurality of tissues 36, such tissues typically being provided by interengaged and multi-ply tissues. A covering layer 38, such as a oval disk corresponding to the generally oval and cross sectional shape of the elongated body, is snappingly engaged by suitable tab means 37, formed at annular locations around a downwardly extending skirt edge 39, within the inwardly facing oval surfaces of the inside of the hingedly secured portion 28 and in proximity to its exposed facing edge 41. The covering layer 38 includes a central aperture, such as is shown at 40 and which, upon engaging the covering layer in place, permits a single tissue, see at 42, to be withdrawn at a time.

The hingedly secured portion 28 is actuated from a closed position (as shown in FIG. 2) to an open position (as best seen in FIGS. 1 and 2*b*) in order to reveal the interior 22 of the body shell 12 and to permit the insertion or removal of the pair of eyeglasses 24. A first latch 44 extends axially from the hollow interior 22 in proximity to the first end 26 and includes a depressible button portion 46 extending through the side 20 of the body 12 and capable of being depressed to likewise inwardly space the latch 44 from the side 20. An opposing ledge 48 is formed in an inwardly facing manner in the exposed facing edge 41 of the hingedly secured portion 28 and, upon depressing of the button portion 46, causes the hinged portion 26 to actuate open about a pivot point 50 located at the opposite side 18 proximate the first end 26 and by means of a spring-biased action generated by a coil spring 52.

The further hingedly secured portion 32 is actuated from a closed position 54 to an open position (illustrated in phantom at 56) in order to reveal said interior 22 of the body shell 12 at the second opposite end 30 from the first end 26. A volume of a glass lens cleaning solution is contained within the shell and is provided as an insertable and affixable transparent tube 58 within which the volume of cleaning solution is held. As is also illustrated in FIG. 2*a*, a dispensing pump is insertable within the tube 58 and includes a fluid withdrawing stem 60 and a dispensing pump spray head 62 which includes a collar 64 with internal screw threads which interengage with externally placed threads 66 formed around an upwardly projecting collar of the tube 58. The transparent tube 58 further includes indicia markings 65 which coincide with additional such markings designated at 61 and which form a part of a transparent fluid measuring window 67 provided in axially extending fashion along the first side 18.

The further hingedly secured portion 32 is likewise actuated to the open position 56 utilizing structure similar to that employed with the initial hingedly secured portion 28, again including a latch 68 inwardly actuated by a button portion 70 formed through the bottom second end 30 of the body 12 and so as to release a corresponding opposing ledge 72 formed along an inwardly facing edge surface of the hingedly secured portion 32. In this fashion, the hingedly secured portion 32 is released to its open actuated position in order to display a further subcompartmented area 74 (see FIG. 2A) from the hollow interior 22 and for specifically receiving the insertable tube 58 without interfering with the space occupied by the eyeglasses 24.

In use, and upon removing the pair of eyeglasses 24 from the body 12, the push button head 62 of the dispensing pump is employed in a first step to apply cleaning solution to the surfaces of the eyeglass lenses. A selected one or more tissues 36 are withdrawn from the body 12 in a second step to wipe dry the solution from the cleaned lenses.

Figure 3:
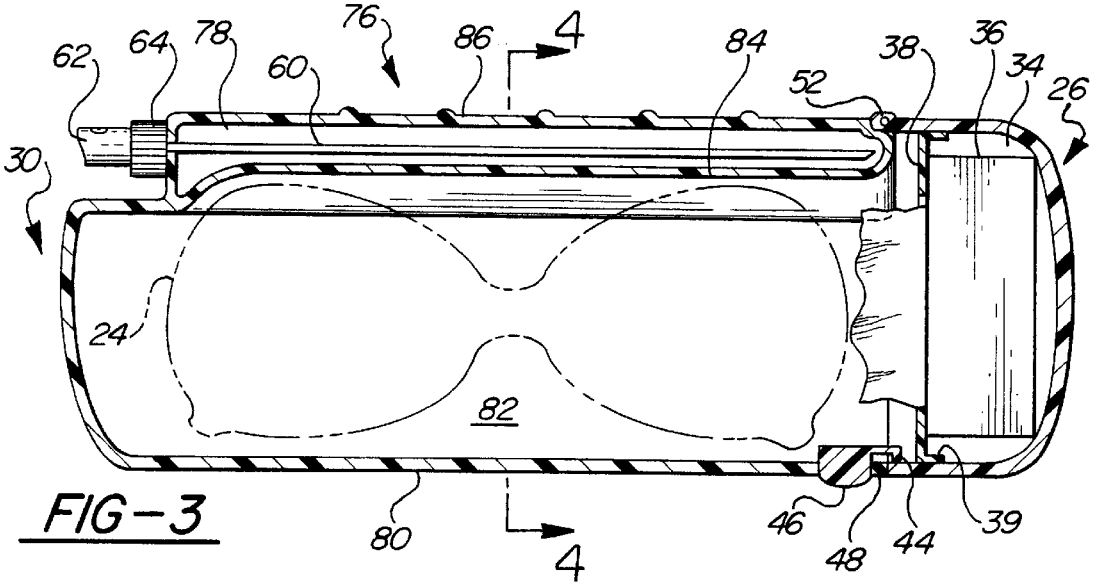
FIG. 3 is a view similar to that shown in FIG. 2 and illustrating a further variant of the first preferred embodiment in which an integrally formed and fluid-tight subcompartment is provided for holding the volume of cleaning solution and extends along an extending side of the body in an axial direction between the first and second ends.

Referring now to FIG. 3 a further variant 76 of the first preferred embodiment is illustrated. The variant 76 of FIG. 3 is largely similar to that described in the first variant of the initial preferred embodiment (shown in FIGS. 1, 2, 2*a* and 2*b*) and differs primarily in that an integrally formed and fluid-tight subcompartment 78 is provided within an alternatively configured body 80 for holding the volume of the cleaning solution. While not shown in FIG. 3, the lid covering the pump spray head 62 is utilized in commercial use (see FIGS. 2 and 2*a*) to prevent accidental depression of the pump head. The integral subcompartment 78, as is also shown in the cutaway cross section of FIG. 3, extends in an axial and lengthwise fashion relative to a main hollow interior 82 along a designated side of the body, and is separated by an internal wall 84 separating the interior 82 and subcompartment 78 between the first end 26 and the second end 30.

Aside from providing an integral and waterproof subcompartment 78 for directly receiving a volume of the cleaning solution, the other structure in the variant 76 does not significantly differ from that illustrated in the initial preferred variant of the first embodiment 10. Specifically, the plurality of tissues 36 held within the interior cavity 34 defined in the hingedly secured portion and secured in place by the covering layer 38 are repeated with identical numeration as being unchanged from the initial variant. Likewise, the features of the latch release mechanism (elements 44, 46, 48, and 52) of the first hingedly secured portion 26 are again repeated. The second hingedly secured portion is however deleted from the variant 76 at the second opposite end, in favor of the integral construction of the fluid holding subcompartment 78 and the screw threaded affixation of the pump dispenser with push button head 62, twist collar 64 and fluid withdrawing stem 60. As with the first variant, a transparent fluid measuring window 86 may be provided along an edge of the associated extending side and indicates when it is necessary to refill the fluid tight subcompartment.

Figure 4:
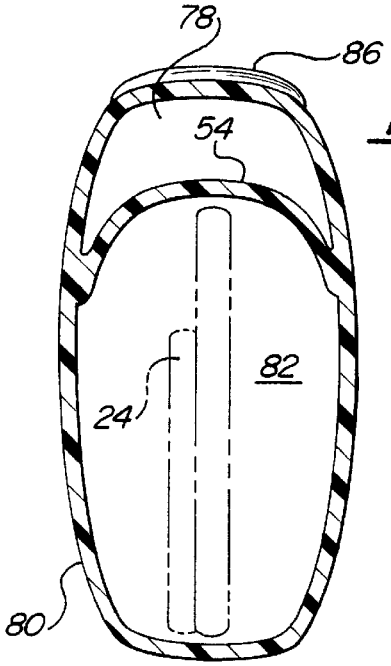
FIG. 4 is a cutaway view taken along line 4—4 of FIG. 3 and illustrating in cross section the arrangement of the cleaning solution subcompartment in combination with the hollow interior for receiving the eyeglasses.
Figure 5:
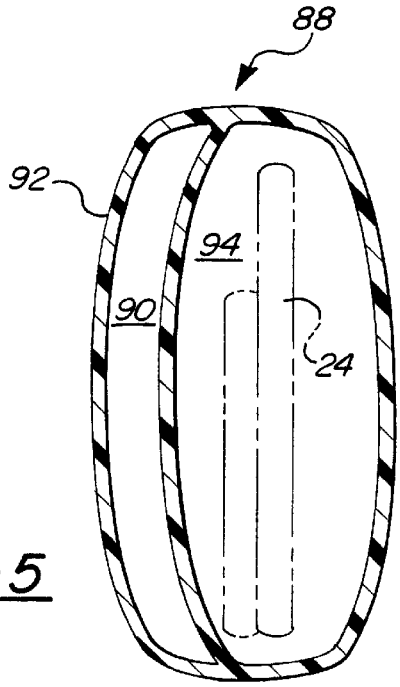
FIG. 5 is a view similar to that shown in FIG. 4 and illustrating a further alternative variant in which the integral fluid carrying subcompartment is formed so as to extend in proximity to a selected flattened face and between the first and second ends.

Referring now to FIG. 5, a view similar to that shown in FIG. 4 is likewise illustrated at 88 and includes the integral fluid carrying subcompartment being formed at 90 and extending in proximity to a selected flattened face 92 of the alternatively configured body and between the first and second ends. A main hollow interior 94 is configured in a somewhat more narrowed and wider fashion, as opposed to the hollow interior 82 of the alternate variation of FIGS. 3 and 4, but is still sufficiently dimensioned in both cross wise and elongate extending fashion so as to adequately receive and hold the pair of eyeglasses 24.

Figure 6:
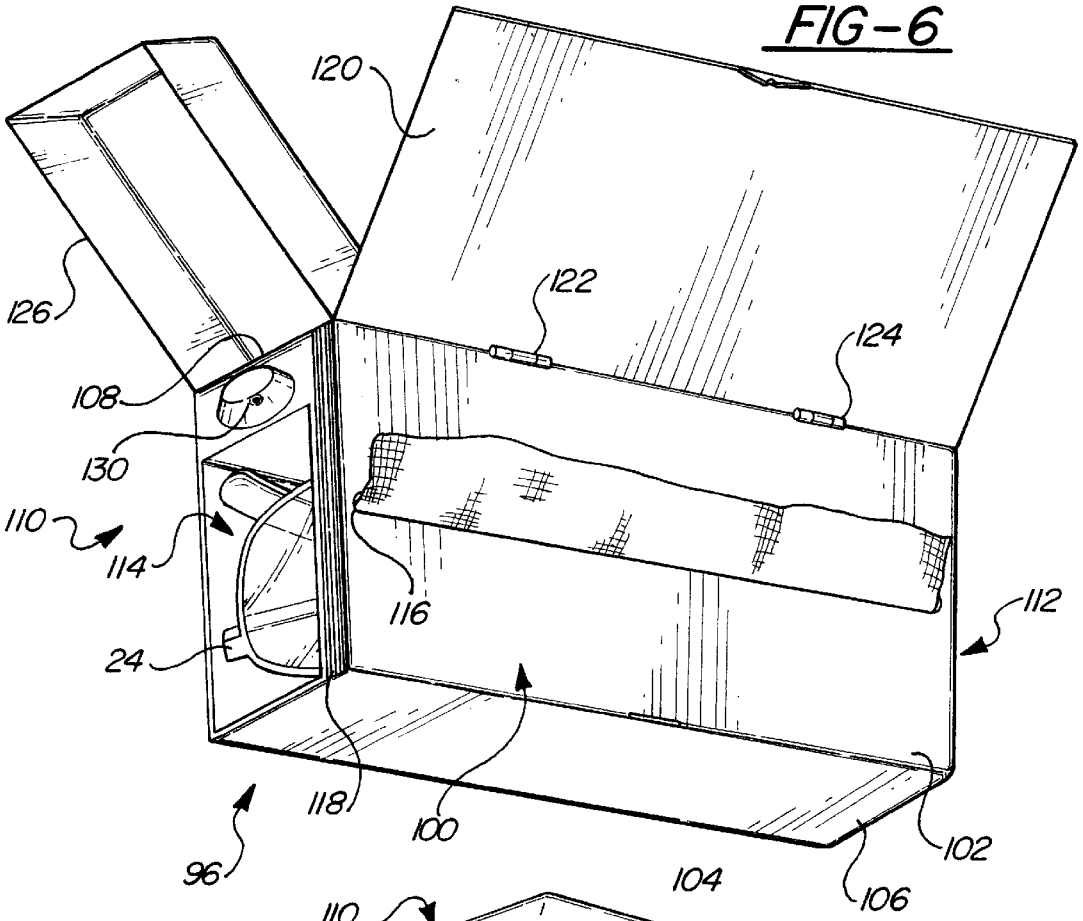
FIG. 6 is a perspective view of the multi-purpose eyeglass holding and cleaning kit according to a second preferred embodiment of the present invention.
Figure 7:
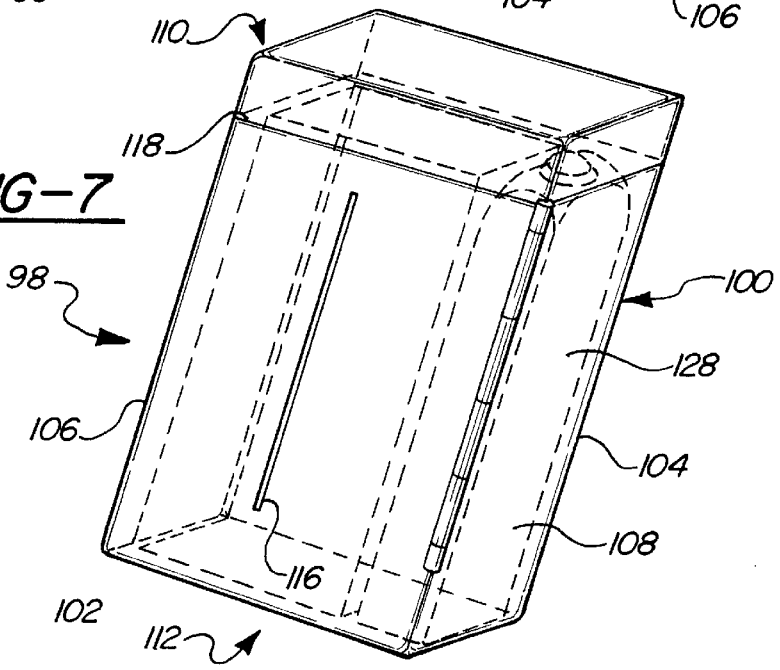
FIG. 7 is further perspective view, similar that that shown in FIG. 6, and illustrating in phantom the arrangement of tissue holding subcompartment extending lengthwise and in proximity to a selected one of the flattened faces, combined with a likewise axially extending and separated subcompartment within which is secured the cleaning solution container.

Referring finally to FIGS. 6 and 7, further perspective views are illustrated at 96 and 98 of the multi-purpose eyeglass holding and cleaning kit according to a second preferred embodiment of the present invention. A body 100 is provided with an outer shell constructed of a durable material. The body 100 has a selected length, width and thickness with first and second flattened faces 102 and 104, a first extending side 106, a second extending side 108, a first end 110 and a second end 112 which defines in combination a generally elongate and rectangular shaped article with a hollow interior 114 suitable for receiving in inserting fashion the pair of eyeglasses 24.

A tissue withdrawing aperture 116 is formed along the first flattened face 102 and in proximity to a tissue holding subcompartment 118 defined within the body 100. The compartment 118 holds a plurality of individual tissues which are capable of being selectively withdrawn from the subcompartment and through the aperture 116. An elongate, planar shaped and hingedly secured portion 120 extends across the selected flattened face 102, the portion 120 being hingedly connected at 122 and 124 along an edge location of the body 100 separating the selected flattened face 102 and the adjoining extending side 108 and being actuable from a first closed position to a second open position to reveal said tissue withdrawing aperture 116.

The first end 110 is also defined by a further hingedly secured portion 126 which is actuated from a closed position to an open position, as is best shown in FIG. 6, and in order to reveal the interior 114 of the shell body 100 to permit the insertion or removal of the pair of eyeglasses 24. A volume of a glass lens cleaning solution contained within the shell. The cleaning solution further includes, as with the first preferred variant, a dispensing pump 128 (see phantom illustration of FIG. 7) incorporated within the body 100. The pump again includes a depressible head 130 which is revealed upon actuating the further hingedly secured portion 126 to the open position.

While the hingedly secured portion 126 does not contain the plurality of tissues, as with the earliest disclosed embodiment, it is understood that the hinged portion 126 may still be constructed so as to define a three dimensional interior cavity as illustrated. Alternatively, the hinged portion 126 may be provided as a rounded covering (not shown) or other shape for enclosing both the spray pump head and the hollow interior for receiving the eyeglasses. FIG. 7 largely repeats the subject matter shown in FIG. 6, and illustrating in phantom the arrangement of tissue holding subcompartment 118 extending lengthwise and in proximity to the selected flattened face 102, combined with the axially extending and separated subcompartment within which is secured the cleaning solution container 108. It is also evident that the multi-purpose kit shown in FIGS. 6 and 7 may be provided as a single unit, not requiring a separately insertable cleaning solution container, as described in the earlier embodiments. It is also understood that, in the preferred variant, the compartment 118 for holding the tissues is integrally formed with the body of the device, but may also be separately attached as an individual component by screw fasteners or the like (not shown). The hinged portion 120 may also form a part of a separate component as described herein.

Having described my invention, it will be apparent that it discloses a novel and useful multi-purpose eyeglass holding and cleaning kit which is a significant improvement over that taught by the prior art. Additional embodiments will become apparent to those skilled in the art to which it pertains without deviating from the scope of the appended claims. Specifically, the elongate and three dimensional body can be provided as first and second telescoping and axially adjustable tubes and so as to establish an overall length of the body to accommodate different sized eyeglasses. Additionally, the glass cleaning fluid can be incorporated and applied in additional variations beyond those specifically disclosed, such as being held entirely within a selected three dimensional hingedly secured portion attached to either a selected end or a selected flattened face of the body.

I claim:

1. A multi-purpose eyeglass holding and cleaning kit capable of storing a pair of eyeglasses, said eyeglass holding and cleaning kit comprising:

a body with an outer shell constructed of a durable material, said body having a selected length, width and thickness which defines a generally elongate article with a hollow interior suitable for receiving in inserting fashion the pair of eyeglasses, said body further having a first end and a second end;

a selected one of said first and second ends being defined by a hingedly secured portion which is actuated from a closed position to an open position in order to reveal an interior of said shell and to permit the insertion or removal of the pair of eyeglasses;

a volume of a glass lens cleaning solution contained within said shell at a first selected location, said cleaning solution further including a dispensing pump incorporated within said body; and a plurality of tissues contained within said shell and accessible from a second selected location;

whereupon, when the pair of eyeglasses are removed from said body, said dispensing pump is employed in a first step to apply cleaning solution to the surfaces of the eyeglass lenses and a selected one or more tissues are withdrawn from said in a second step to wipe dry the solution from the cleaned lenses.

2. The multi-purpose eyeglass kit according to claim 1, said hingedly secured portion further comprising an interior cavity within which is contained said plurality of tissues, a covering layer enclosing said tissues further having defined therethrough an aperture for permitting successive withdrawing of said tissues.

3. The multi-purpose eyeglass kit according to claim 1, further comprising the other of said first and second ends of said body being defined by a further hingedly secured portion which is actuated from a closed position to an open position to reveal a head of said dispensing pump.

4. The multi-purpose eyeglass kit according to claim 3, further comprising an insertable and affixable transparent tube within which said volume of cleaning solution is held, an externally viewable and transparent fluid measuring window being provided along a selected edge of said body and in proximity to said insertable tube.

5. The multi-purpose eyeglass kit according to claim 1, further comprising said hingedly secured portion being actuated to said open position in order to reveal a head of said dispensing pump.

6. The multi-purpose eyeglass kit according to claim 1, said body further comprising an integrally formed and axially extending subcompartment within which said volume of cleaning solution is held, said dispensing pump further including a fluid withdrawing stem extending from a spray pump head, said dispensing pump being engageable over an open end location of said subcompartment.

7. The multi-purpose eyeglass kit according to claim 6, said generally elongate extending body further comprising first and second flattened faces, a first extending side and a second opposite extending side, said integrally formed and fluid holding subcompartment being defined in proximity to a selected extending side between said first end and said second end.

8. The multi-purpose eyeglass kit according to claim 6, said generally elongate extending body further comprising first and second flattened faces, a first extending side and a second opposite extending side, said integrally formed and fluid holding subcompartment being defined in proximity to a selected extending face between said first end and said second end.

9. The multi-purpose eyeglass kit according to claim 1, said generally elongate extending body further comprising first and second flattened faces, a first extending side and a second opposite extending side, a tissue withdrawing aperture being formed through said body along a selected face and in proximity to a tissue holding subcompartment defined within said body, a further elongate, planar shaped and hingedly secured portion extending across said selected face and being actuable from a first closed position to a second open position to reveal said tissue withdrawing aperture.

10. A multi-purpose eyeglass holding and cleaning kit capable of storing a pair of eyeglasses, said eyeglass holding and cleaning kit comprising:

a body with an outer shell constructed of a durable material, said body having a selected length, width and thickness defined by first and second flattened faces, a first extending side and a second extending side and which defines a generally elongate article with a hollow interior suitable for receiving in inserting fashion the pair of eyeglasses, said body further having a first end and a second end;

said first end being defined by a hingedly secured portion which is actuated from a closed position to an open position in order to reveal an interior of said shell and to permit the insertion or removal of the pair of eyeglasses, said hingedly secured portion further including an interior cavity within which is contained a plurality of tissues, a covering layer enclosing said tissues and having further defined therethrough an aperture for permitting successive withdrawal of said tissues;

said second end being defined by a further hingedly secured portion which is actuated from a closed position to an open position in order to reveal said interior of said shell at an opposite end from said first end, a volume of a glass lens cleaning solution being contained within said shell, said cleaning solution further including a dispensing pump incorporated within said body and revealed by actuation of said further hingedly secured portion; and whereupon, when the pair of eyeglasses are removed from said body, said dispensing pump is employed in a first step to apply cleaning solution to the surfaces of the eyeglass lenses and a selected one or more tissues are withdrawn from said body in a second step to wipe dry the solution from the cleaned lenses.

11. A multi-purpose eyeglass holding and cleaning kit capable of storing a pair of eyeglasses, said eyeglass holding and cleaning kit comprising:

a body with an outer shell constructed of a durable material, said body having a selected length, width and thickness with first and second flattened faces, a first extending side, a second extending side, a first end and a second end which defines in combination a generally elongate and rectangular shaped article with a hollow interior suitable for receiving in inserting fashion the pair of eyeglasses;

a tissue withdrawing aperture being formed along a selected one of said flattened faces and in proximity to a tissue holding subcompartment defined within said body, an elongate, planar shaped and hingedly secured portion extending across said selected flattened face, said portion being hingedly connected along an edge location of said body separating said selected flattened face and an adjoining extending side and being actuable from a first closed position to a second open position to reveal said tissue withdrawing aperture;

a selected one of said first and second ends being defined by a further hingedly secured portion which is actuated from a closed position to an open position in order to reveal an interior of said shell and to permit the insertion or removal of the pair of eyeglasses;

a volume of a glass lens cleaning solution contained within said shell, said cleaning solution further including a dispensing pump incorporated within said body, said pump including a depressible head which is revealed upon actuating said further hingedly secured portion to said open position;

whereupon, when the pair of eyeglasses are removed from said body, said dispensing pump is employed in a first step to apply cleaning solution to the surfaces of the eyeglass lenses and a selected one or more tissues are withdrawn from said tissue holding subcompartment in a second step to wipe dry the solution from the cleaned lenses.

* * * * *